US008517160B2

(12) United States Patent
Kayani

(10) Patent No.: US 8,517,160 B2
(45) Date of Patent: Aug. 27, 2013

(54) METHOD FOR CONTROLLING NOTE THROUGHPUT

(75) Inventor: Sohail Kayani, Irving, TX (US)

(73) Assignee: Toshiba International Corporation, Houston, TX (US)

( * ) Notice: Subject to any disclaimer, the term of this patent is extended or adjusted under 35 U.S.C. 154(b) by 0 days.

(21) Appl. No.: 12/557,220

(22) Filed: Sep. 10, 2009

(65) Prior Publication Data

US 2010/0059419 A1 Mar. 11, 2010

Related U.S. Application Data

(60) Provisional application No. 61/096,200, filed on Sep. 11, 2008, provisional application No. 61/096,224, filed on Sep. 11, 2008.

(51) Int. Cl.
*G07F 7/04* (2006.01)

(52) U.S. Cl.
USPC ..... 194/206

(58) Field of Classification Search
USPC ..... 194/206, 344, 350; 271/3.14, 3.15, 271/3.16, 3.17, 4.02, 4.03, 8.1, 256, 258.1, 271/259, 266, 270; 198/577, 579, 623, 761, 198/762; 209/534; 235/379
See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 4,451,027 | A * | 5/1984 | Alper | 271/10.02 |
| 6,224,049 | B1 * | 5/2001 | Hosking et al. | 271/10.03 |
| 6,640,156 | B1 * | 10/2003 | Brooks et al. | 700/213 |
| 2002/0066125 | A1 | 5/2002 | Mukai | |
| 2004/0255354 | A1 | 12/2004 | Graef et al. | |
| 2006/0011447 | A1 | 1/2006 | Hornung et al. | |

FOREIGN PATENT DOCUMENTS

| | | | |
|---|---|---|---|
| EP | 0651356 | A1 | 5/1995 |
| EP | 1164553 | A2 | 12/2001 |
| EP | 1 324 285 | | 2/2003 |
| KR | 10-2006-0108399 | | 10/2006 |

OTHER PUBLICATIONS

PCT/US2009/056699, international filing date Sep. 11, 2009; See, PCT International Search Report mailed on Apr. 28, 2010 (from parent U.S. Appl. No. 61/096,212, filed Sep. 11, 2008 and U.S. Appl. No. 12/556,328, filed Sep. 9, 2009).

* cited by examiner

*Primary Examiner* — Mark Beauchaine
(74) *Attorney, Agent, or Firm* — Baker Botts L.L.P.

(57) ABSTRACT

A method and apparatus for controlling note throughput in real time through a currency processing machine. The invention involves the use of asynchronous components, such as independently driven feeder, transport, and final disposition components, to vary individual note velocity and horizontal distance between notes as they are being processed. The adjustments are made in real time based on detected note quality characteristics and event characteristics of the inputting source of the notes.

19 Claims, 3 Drawing Sheets

METHOD FOR CONTROLLING NOTE THROUGHPUT

CROSS-REFERENCE TO RELATED APPLICATIONS

This application claims the benefit of provisional Application No. 61/096,200, filed Sep. 11, 2008.

This application also claims the benefit of provisional Application No. 61/096,224, filed Sep. 11, 2008.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a method for controlling the throughput of notes processed by a high speed currency processing machine. Specifically, the invention relates to the use of asynchronous components with a currency processing machine in order to manipulate both currency feed density and currency speed through the processor.

2. Description of Related Art Including Information Disclosed Under 37 CFR 1.97 and 1.98

High speed currency processors are common in the fields of bulk currency processing and are used by central banks, large commercial banks, print works, cash in transit, and other entities that require the processing of large amounts of currency. In operation, notes that require processing are fed into the high speed currency processing machine by a note feeder. These notes then travel down a high speed conveyor past a number of detectors which detect various characteristics of the note. Based on the note characteristics detected, the note is then routed to any number of pockets for collation. These pockets enable the high speed currency machine to sort notes by fitness level, denomination, origin, authentication, etc The throughput of the notes in a currency processing machine is limited by the speed that the notes travel through the machine, as well as the distance between individual notes (currency feed density). Further, prior art high speed currency processing machines mechanically or electronically register the speeds of all of the various components (note feeder, conveyor speed, final disposition collection) in order to ensure that the flow of the notes is continuous and that jamming is avoided. This registration of all the components is typically accomplished by using a single large electric motor to drive timing belts and gears that are all registered to operate at fixed relative speeds or electronically do the same. Prior art currency processing machines can be said to use synchronous components, given that they all operate at the same relative speed, speeding up or slowing down relative to each other. In regular operation they wait on a constant speed.

The distance between each note is fixed in prior art machines and is determined by the velocity of the conveyor, the infeed rate of the note feeder, and the length of the note. The ultimate note velocity is limited by the note's ability to proceed in a linear fashion down the horizontal conveyor without folding or bending as it encounters higher wind resistance with increasing speed and its metric notes. The more limp or more worn the note is, as well as the quality of the note, determines what the optimum speed can be before the notes begin to deflect and jam the equipment. However, prior art machines, which are not adjustable, typically operate at a fixed "safe" speed regardless of the quality of the notes. The best throughput achievable by prior art currency processing machines is in the neighborhood of 40 notes per second.

Consequently, the need exists for a method and apparatus for controlling the throughput of notes processed by a high speed currency processing machine. Such invention should allow for increasing note throughput without changing the velocity of the individual notes as they proceed along the note path through the currency processing machine or change the speed of the notes going through or accomplish both of the above. Further, such invention should be able to automatically adjust the throughput of notes through the currency processing machine, depending on the detected note quality of the batch of the notes that are being processed and by the machine having built in the heuristics to remember the incoming source of the notes (i.e., the quality and source and denomination to set initial speed).

BRIEF SUMMARY OF THE INVENTION

A method for controlling note throughput in a currency processing machine having a bank note transport path, wherein the note processing machine comprises an asynchronous note feeder module, a detection module, and one or more final disposition modules, each module comprising an asynchronous transport path mechanism, wherein each respective transport path mechanism defines the bank note transport path, the method steps comprising: determining an optimum note velocity along the note transport path based on real-time detected note characteristics; determining an optimum note separation along the note transport path based on real-time detected note characteristics; and adjusting independently the feeder module bank note feed rate and the feeder module transport mechanism transport speed based on the above determinations of the optimum note velocity and the optimum note separation.

A currency processing machine having a bank note transport path defined by various transport components, the machine comprising: a feeder module comprising an asynchronous feeder mechanism and an asynchronous transport mechanism, the feeder mechanism in bank note communication with the transport mechanism; a detection module comprising an asynchronous transport mechanism, the detection module transport mechanism in bank note communication with the feeder module transport mechanism; and at least one final disposition module comprising a transport mechanism, the disposition module transport mechanism in bank note communication with the detection module transport mechanism.

A currency processing machine having a bank note transport path defined by various transport components, the machine comprising: a feeder module comprising an asynchronous feeder mechanism and an asynchronous transport mechanism, the feeder mechanism in bank note communication with the transport mechanism.

These and other improvements will become apparent when the following detailed disclosure is read in light of the supplied drawings. This summary is not intended to limit the scope of the invention to any particular described embodiment or feature. It is merely intended to briefly describe some of the key features to allow a reader to quickly ascertain the subject matter of this disclosure. The scope of the invention is defined solely by the claims when read in light of the detailed disclosure.

BRIEF DESCRIPTION OF THE SEVERAL VIEWS OF THE DRAWING(S)

The present invention will be more filly understood by reference to the following detailed description of the preferred embodiments of the present invention when read in conjunction with the accompanying drawings, in which like reference numbers refer to like parts throughout the views, wherein.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

DETAILED DESCRIPTION OF THE INVENTION

As noted previously, typical currency processing machines comprise a note feeder device, a transport device or belt along which notes travel in a horizontal direction past several detectors, and a final disposition component, which comprises typically a pocket for collection of processed notes, a strapper for strapping the notes in bundles, and a means for depositing the notes into the pocket by pulling the notes from the note processing path or transport device. As also noted previously, such currency processing machines operate by mechanically linking the rates and speeds of all of these devices by way of timing belts driven by a single large motor or electronically link multiple motors. Consequently, once the rates and speeds of these components have been set, they cannot be changed during the operation of the machine.

The present invention, in one embodiment, separates all of the above-listed functions into independently operating modules, each having independently driven motors. For example, Applicant's invention involves the use of an electric note feeder that is capable of independent operation from the transport mechanism of a currency processing machine. This note feeder has an adjustable rate of note input into the transport mechanism. This rate can be adjusted while the currency processing machine is in operation, for example based on detected note characteristics of the notes being processed. Likewise, Applicant's invention uses a transport mechanism that is driven independently by its own means, such as one or more electric motors in series. Rather than syncing the speed of these motors by mechanical linkage through timing belts or electronically, Applicant's invention syncs the speed of the various motors through the transport device by variable and adaptive electronic means.

The present invention can also comprise individual modules for each disposition component. Again, these individual modules for disposition components operate at independent rates from those rates and speeds of the note feeder and transport components.

Figure 1:
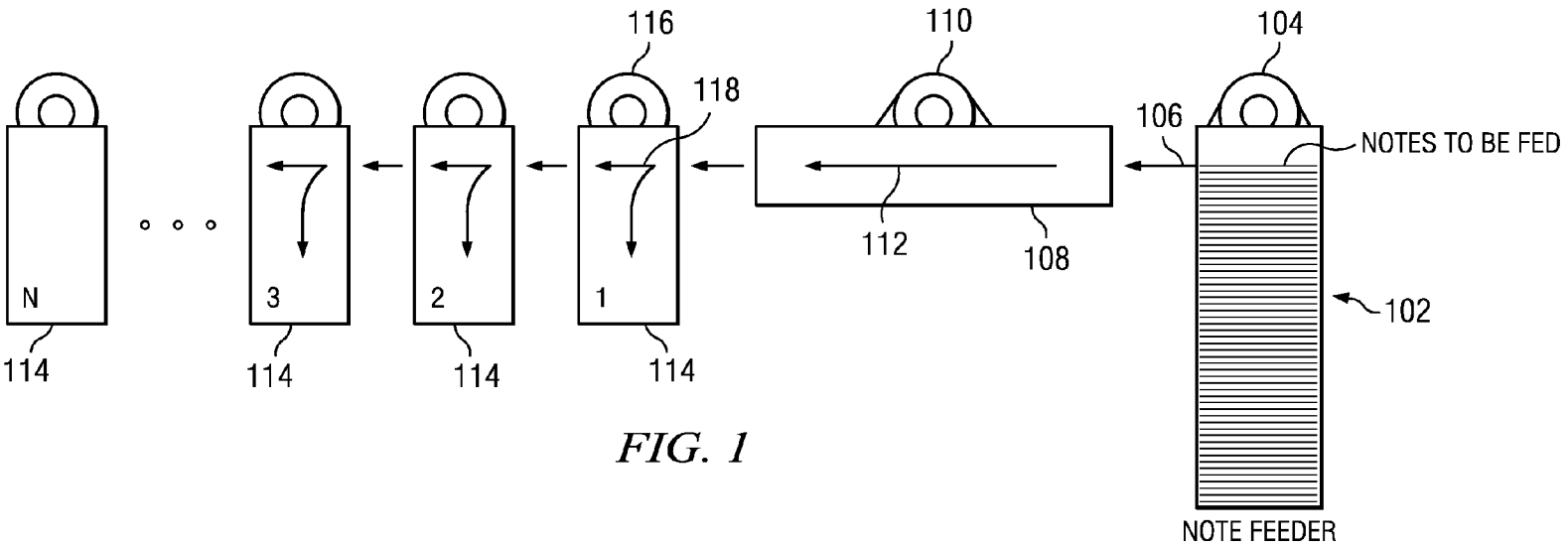
FIG. 1 depicts a schematic diagram of an embodiment of a currency processing machine that incorporates the present invention.

FIG. 1 depicts a schematic diagram of an embodiment of a currency processing machine that incorporates the present invention. As shown in this figure, a first module is the note feeder (102). The note feeder component (102) utilizes an independently controlled drive mechanism (104) to establish note feed rate into the note feeder transport component (106). The note feeder transport component (106) utilizes its own independently controlled drive mechanism to allow it to operate at a rate independent of the feeder.

Figure 2:
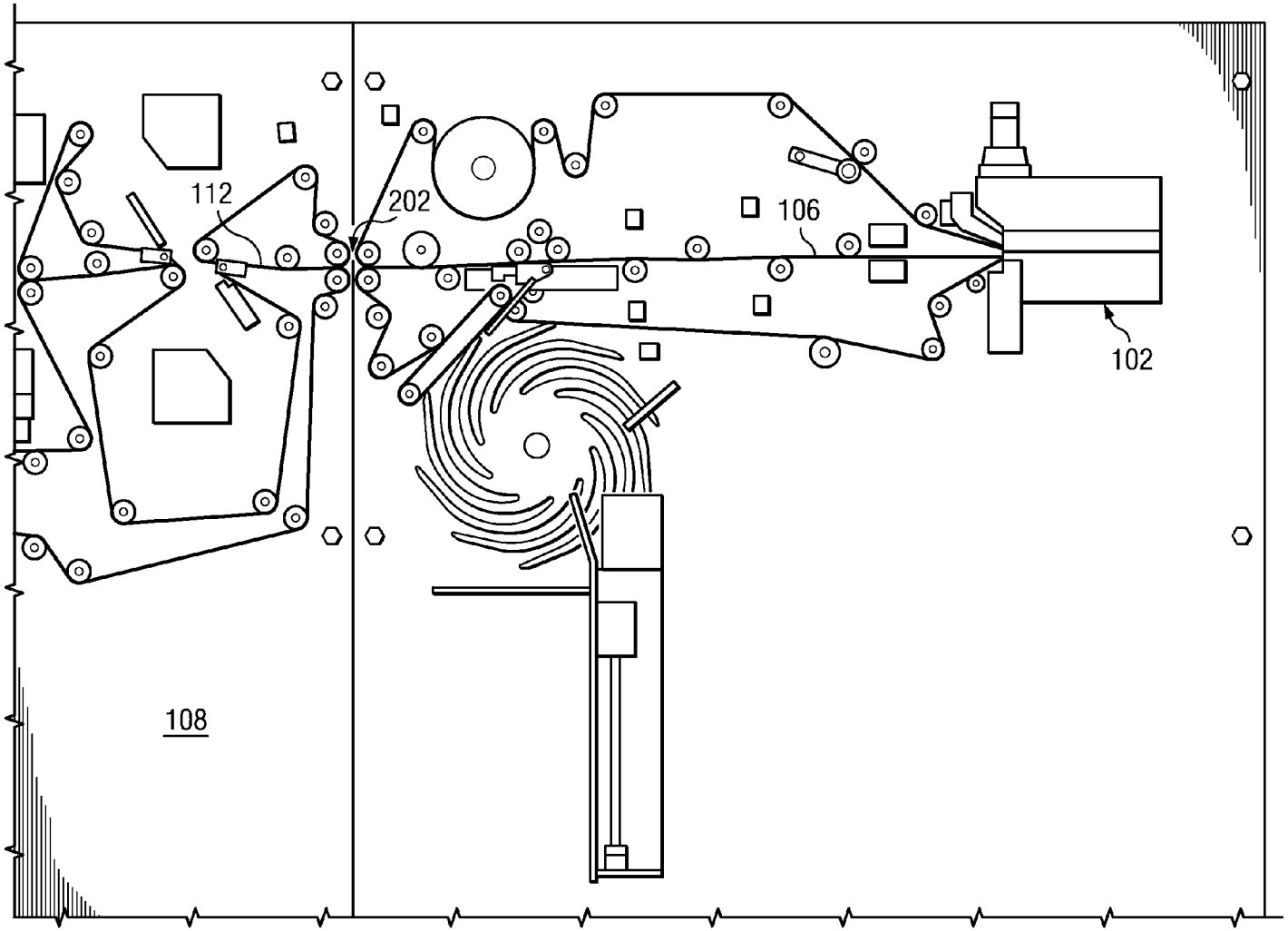
FIG. 2 depicts a detailed view of the transport paths at the feeder component and detector component interface of this embodiment.

The next module of the present embodiment is the detection module (108). The detection module (108) provides most of the note detection capabilities as described herein. The detection module, likewise, utilizes an independently controlled drive mechanism (110) to power the detection module transport component (112). FIG. 2 depicts a more detailed view of the transport paths at the feeder module and detector module interface. As shown in this drawing, the feeder component transport path (106) and the detection component transport path (112) are separated by a gap (202) that is sufficiently narrow to allow notes to pass from the feeder to the detector without the respective transport mechanism belts coming into physical contact. Thus, there is no physical connection between the aforementioned transport path components.

Figure 3:
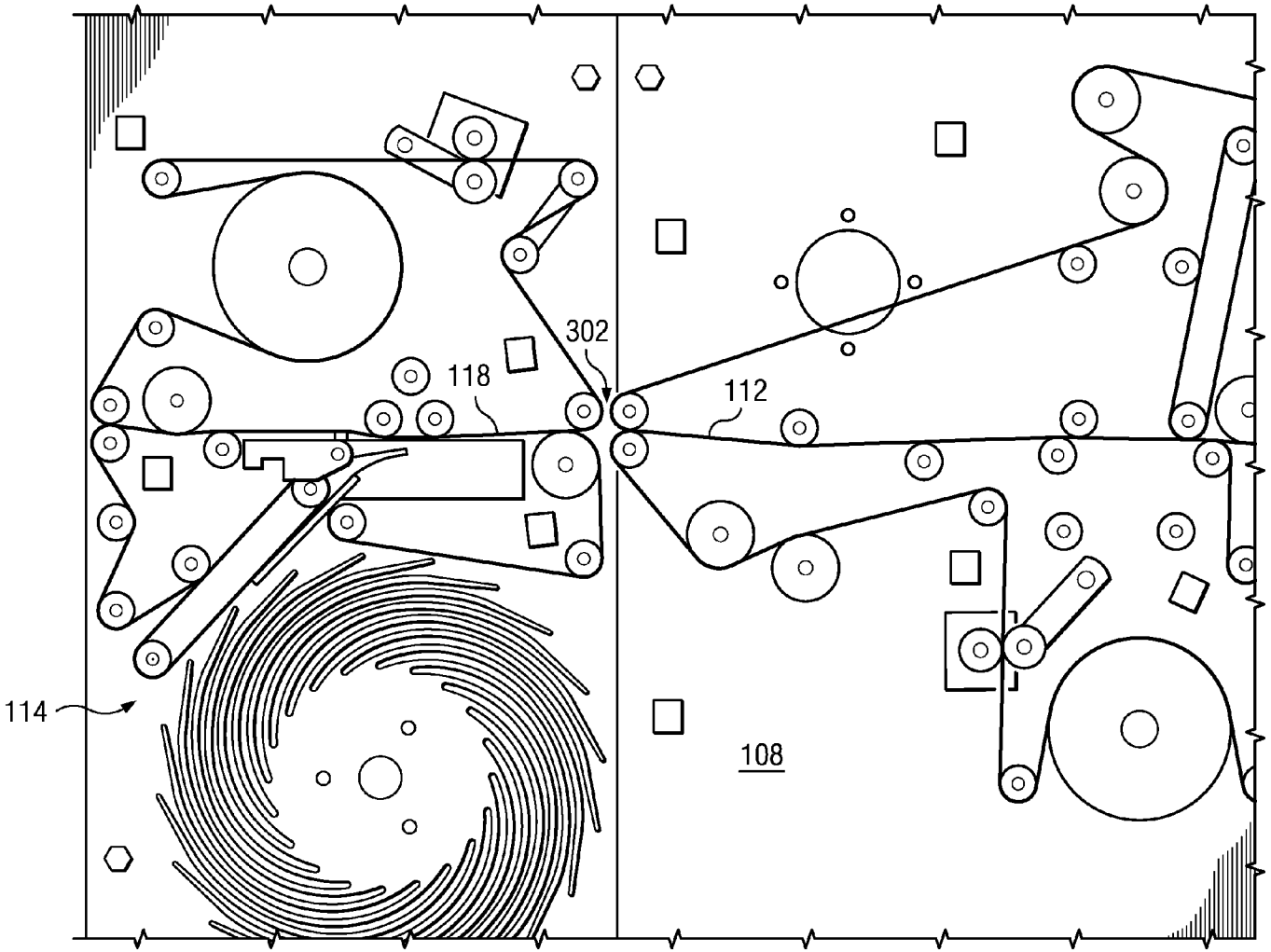
FIG. 3 depicts a detailed view of the transport paths at the detector component and disposition component interface of this embodiment.

Referring again to FIG. 1, the detection module (108) is followed by several disposition modules (114). As depicted, these disposition modules may include stacker or strapper modules for the various note denominations, note granulators, note reject pockets, or the like. Each disposition module (114) includes an independently controlled drive mechanism (116) that powers the disposition module transport path (118). FIG. 3 depicts a more detailed view of the transport paths at the detector module (108) and disposition module (114) interface. As shown, the detection module transport component (112) is physically separated from the disposition module transport component (118) by a narrow gap (302). This gap (302) is sufficiently narrow to allow notes to pass from the detector module (108) to the disposition module (114), without the respective transport mechanism belts coming into physical contact.

One aspect of the invention is the ability to increase note throughput without increasing the speed of the transport mechanism. As noted previously, note throughputs are generally limited to 40 notes per second in prior art currency processing machines. It is possible to obtain higher note throughputs without going beyond the transport speeds used by traditional machines by simply adjusting the distance between the notes on the note processing path. This distance can be shortened by increasing the rate of note input by the note feeder. This aspect of Applicant's invention allows for the real-time modification of the rate of the note feeder based on detected note characteristics such as the type of notes being processed and the quality of the notes being processed. The logic of Applicant's invention allows for the note feeder to increase its rate of infeed in order to increase the overall throughput.

Figure 4:
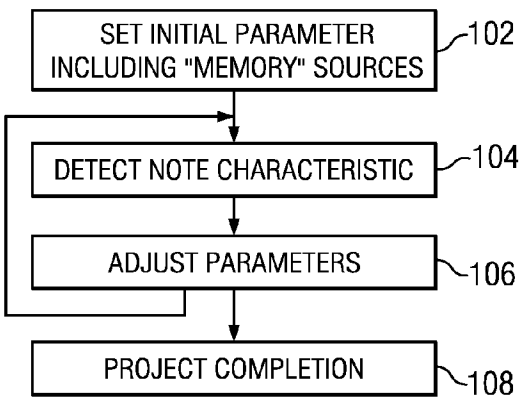
FIG. 4 depicts a flow chart of the logic of an embodiment of the present invention.

FIG. 4 is a flow chart of the logic of one embodiment of Applicant's invention. The first step (402) involves setting initial parameters on the independently operating components. Such initial parameter settings (402) can be either default settings used when there is no program override or inputted program settings based on the types of notes to be processed. These initial parameters can include the note infeed rate from the note feeder, the speed of the transport device, and the collection rate of the final disposition components. The system also looks at the imputing source to determine note quality.

Once the initial parameters are set (402), the currency processing machine begins to detect note characteristics (404). Such detected note characteristics (404) can include the detection of characteristics that indicate the ability of the batch of notes being processed to proceed along the note currency path at a given velocity. For example, the general limpness of the notes being processed can be detected. Limper notes must be processed at lower transport speeds or individual note velocities in order to avoid equipment jamming and misfeeds. In order to keep the throughput rate at a maximum, the present embodiment can compensate by decreasing the speed and increasing the notes gap, causing fewer stops and thus increasing throughput. In other words, if the logic of Applicant's invention indicates that the velocity of the notes should be decreased by 10% in order to avoid jamming or misfeeds, or the note gap increased by 10% or a combination of both to keep over all throughput as high as possible at max speed and smaller gaps to exceed 40 notes per second.

Referring again to FIG. 4, the third step (406) refers to the adjustment of parameters based on the detected note characteristics as previously described. The parameters that are adjusted in the third step (406) are those same parameters that were initially set (402) at the beginning of the note processing cycle. It should be noted that the second step (404) and the third step (406) are in a repeating loop. This reflects the fact that Applicant's invention allows for real-time adjustment of the processing parameters based on real-time detection of note characteristics. Thus, a currency processing machine operating by Applicant's methods is constantly adjusting note feeder input rate, transport component speed, and final disposition component receiving rates, in order to obtain the optimum and maximum currency processing throughput given the notes that are being processed. This constant adjustment occurs without intervention from the operator and may not even be noticed if, for example, a desired set point of note throughput is set by the operator. This constant adjustment as between detection (404) and adjustment of parameters (406) concludes when the currency processing cycle is finished (408) (project completion).

Claim 1 A method for controlling note throughput in a currency processing machine having a bank note transport path, wherein the note processing machine comprises an asynchronous note feeder module, a detection module, and one or more final disposition modules, each module comprising an asynchronous transport path mechanism, wherein each respective transport path mechanism defines the bank note transport path, the method steps comprising: determining an optimum note velocity along the note transport path based on real-time detected note characteristics; determining an optimum note separation along the note transport path based on real-time detected note characteristics; and adjusting independently the feeder module bank note feed rate and the feeder module transport mechanism transport speed based on the above determinations of the optimum note velocity and the optimum note separation.

Claim 2 The method of Claim 1, the method steps further comprising: adjusting independently the detection module transport mechanism speed based on the above determinations of the optimum note velocity and the optimum note separation.

Claim 3 The method of Claim 2, the method steps further comprising: adjusting independently each disposition module transport mechanism speed based on the above determinations of the optimum note velocity and the optimum note separation.

Claim 4 The method of Claim 1, the method steps further comprising: adjusting independently the detection module transport mechanism speed to conform with the feeder module transport mechanism transport speed.

Claim 5 The method of Claim 4, the method steps further comprising: adjusting independently each disposition module transport mechanism speed to conform with the detection module transport mechanism speed.

Claim 6 A currency processing machine having a bank note transport path defined by various transport components, the machine comprising: a feeder module comprising an asynchronous feeder mechanism and an asynchronous sport mechanism, the feeder mechanism in bank note communication with the transport mechanism; a detection module comprising an asynchronous transport mechanism, the detection module transport mechanism in bank note communication with the feeder module sport mechanism; and at least one final disposition module comprising a transport mechanism, the disposition module transport mechanism in bank note communication with the detection module transport mechanism.

Claim 7 The currency processing machine of Claim 6, the machine further comprising: a computer processing device, the processing device capable of executing stored computer program instructions, the program instruction steps comprising: determining an optimum note velocity along the note transport path based on real-time detected note characteristics; determining an optimum note separation along the note transport path based on real-time detected note characteristics; and adjusting independently the feeder module bank note feed rate and the feeder module transport mechanism transport speed based on the above determinations of the optimum note velocity and the optimum note separation.

Claim 8 The currency processing machine of Claim 7, the program instruction steps further comprising: adjusting independently the detection module transport mechanism speed based on the determinations of the optimum note velocity and the optimum note separation.

Claim 9 The currency processing machine of Claim 8, the program instruction steps further comprising: adjusting independently each disposition module transport mechanism speed based on the determinations of the optimum note velocity and the optimum note separation.

Claim 10 A currency processing machine having a bank note transport path defined by various transport components, the machine comprising: a feeder module comprising an asynchronous feeder mechanism and an asynchronous transport mechanism, the feeder mechanism in bank note communication with the transport mechanism.

Claim 11 The currency processing machine of Claim 10, the machine further comprising: a computer processing device, the processing device capable of executing stored computer program instructions, the program instructions comprising: determining an optimum note velocity along the note transport path based on real-time detected note characteristics; determining an optimum note separation along the note transport path based on real-time detected note characteristics; and adjusting independently the feeder module bank note feed rate and the feeder module transport mechanism transport speed based on the above determinations of the optimum note velocity and the optimum note separation.

Claim 12 The currency processing machine of Claim 11, the machine further comprising: a detection module comprising an asynchronous transport mechanism, the detection module transport mechanism in bank note communication with the feeder module transport mechanism.

Claim 13 The currency processing machine of Claim 12, the program instruction steps further comprising: adjusting independently the detection module transport mechanism speed based on the determinations of the optimum note velocity and the optimum note separation.

Claim 14 The currency processing machine of Claim 12, the machine further comprising: at least one final disposition module comprising a transport mechanism, the disposition module transport mechanism in bank note communication with the detection module transport mechanism.

Claim 15 The currency processing machine of Claim 14, the program instruction steps further comprising: adjusting independently each disposition module transport mechanism speed based on the determinations of the optimum note velocity and the optimum note separation.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than that recited unless the particular claim expressly states otherwise.

I claim:

1. A method for controlling note throughput in a currency processing machine having a bank note transport path, wherein the note processing machine comprises an asynchronous note feeder module, a detection module, and one or more final disposition modules, each module comprising an asynchronous transport path mechanism, wherein each respective transport path mechanism defines the bank note transport path, the method steps comprising:

determining an optimum note velocity along the note transport path based on real-time detected note machineability;

determining an optimum note separation along the note transport path based on real-time detected note machineability; and adjusting independently the feeder module bank note feed rate and the feeder module transport mechanism transport speed based on the above determinations of the optimum note velocity and the optimum note separation.

2. The method of claim 1, the method steps further comprising:

adjusting independently the detection module transport mechanism speed based on the above determinations of the optimum note velocity and the optimum note separation.

3. The method of claim 2, the method steps further comprising:

adjusting independently each disposition module transport mechanism speed based on the above determinations of the optimum note velocity and the optimum note separation.

4. The method of claim 1, the method steps further comprising:

adjusting independently the detection module transport mechanism speed to conform with the feeder module transport mechanism transport speed.

5. The method of claim 4, the method steps further comprising:

adjusting independently each disposition module transport mechanism speed to conform with the detection module transport mechanism speed.

6. The method of claim 1 wherein note machineability comprises a quality condition of the note that affects the speed the note can be moved along the note transport path without jamming.

7. The method of claim 6 wherein the quality condition comprises the limpness of the note.

8. The method of claim 1 wherein the quality condition comprises the limpness of the note.

9. A currency processing machine having a bank note transport path defined by various transport components, the machine comprising:

a feeder module comprising an asynchronous feeder mechanism and an asynchronous transport mechanism, the feeder mechanism in bank note communication with the transport mechanism;

a detection module comprising an asynchronous transport mechanism, the detection module transport mechanism in bank note communication with the feeder module transport mechanism;

at least one final disposition module comprising a transport mechanism, the disposition module transport mechanism in bank note communication with the detection module transport mechanism;

a computer processing device, the processing device capable of executing stored computer program instructions, the program instruction steps comprising:

determining an optimum note velocity along the note transport path based on real-time detected note machineability;

determining an optimum note separation along the note transport path based on real-time detected note machineability; and adjusting independently the feeder module bank note feed rate and the feeder module transport mechanism transport speed based on the above determinations of the optimum note velocity and the optimum note separation.

10. The currency processing machine of claim 9, the program instruction steps further comprising:

adjusting independently the detection module transport mechanism speed based on the determinations of the optimum note velocity and the optimum note separation.

11. The currency processing machine of claim 10, the program instruction steps further comprising:

adjusting independently each disposition module transport mechanism speed based on the determinations of the optimum note velocity and the optimum note separation.

12. The currency processing machine of claim 9 wherein note machineability comprises a quality condition of the note that affects the speed the note can be moved along the note transport path without jamming.

13. The currency processing machine of claim 12 wherein the quality condition comprises the limpness of the note.

14. A currency processing machine having a bank note transport path defined by various transport components, the machine comprising:

a feeder module comprising an asynchronous feeder mechanism and an asynchronous transport mechanism, the feeder mechanism in bank note communication with the transport mechanism;

a computer processing device, the processing device capable of executing stored computer program instructions, the program instructions comprising:

determining an optimum note velocity along the note transport path based on real-time detected note machineability;

determining an optimum note separation along the note transport path based on real-time detected note machineability; and adjusting independently the feeder module bank note feed rate and the feeder module transport mechanism transport speed based on the above determinations of the optimum note velocity and the optimum note separation.

15. The currency processing machine of claim 14, the machine further comprising:

a detection module comprising an asynchronous transport mechanism, the detection module transport mechanism in bank note communication with the feeder module transport mechanism.

16. The currency processing machine of claim 15, the program instruction steps further comprising:

adjusting independently the detection module transport mechanism speed based on the determinations of the optimum note velocity and the optimum note separation.

17. The currency processing machine of claim 15, the machine further comprising:

at least one final disposition module comprising a transport mechanism, the disposition module transport mechanism in bank note communication with the detection module transport mechanism.

18. The currency processing machine of claim 17, the program instruction steps further comprising:

adjusting independently each disposition module transport mechanism speed based on the determinations of the optimum note velocity and the optimum note separation.

19. The currency processing machine of claim 14 wherein note machineability comprises a quality condition of the note that affects the speed the note can be moved along the note transport path without jamming.

* * * * *